US005289813A

United States Patent [19]

Adachi et al.

[11] Patent Number: 5,289,813

[45] Date of Patent: Mar. 1, 1994

[54] TWO SPEED MECHANICAL SUPERCHARGER

[75] Inventors: Kazunari Adachi, Toyoake; Noriyoshi Shibata, Nagoya, both of Japan

[73] Assignee: Aisin Seiki Kabushiki Kaisha, Kariya, Japan

[21] Appl. No.: 935,171

[22] Filed: Aug. 26, 1992

[30] Foreign Application Priority Data

Aug. 28, 1991 [JP] Japan ..... 3-217400
Aug. 28, 1991 [JP] Japan ..... 3-217401

[51] Int. Cl.[5] ..... F02B 33/00

[52] U.S. Cl. ..... 123/559.3; 123/561; 192/48.2; 192/48.9; 192/48.92

[58] Field of Search ..... 419/69; 123/559.3, 561; 192/48.2, 48.9, 48.92

[56] References Cited

U.S. PATENT DOCUMENTS 1,656,867 1/1928 Porsche ..... 123/559.3
4,660,526 4/1987 Horii ..... 123/559.3
4,927,333 5/1990 Kato ..... 123/561

FOREIGN PATENT DOCUMENTS 2-34728 3/1990 Japan .

*Primary Examiner*—Richard A. Bertsch

*Assistant Examiner*—Charles G. Freay

*Attorney, Agent, or Firm*—Oblon, Spivak, McClelland, Maier & Neustadt

[57] ABSTRACT

A mechanical supercharger includes a housing, first, second and third shafts rotatably supported on the housing, respectively, a first timing gear disposed on the first shaft, a second timing gear disposed on the second shaft and engaged with the first shaft timing gear, a first rotor disposed on the first shaft, a second rotor disposed on the second shaft and engaged with the first rotor, a first pulley disposed on one end of the first shaft, an electromagnetic clutch interposed between the first shaft and the first pulley and being selectively intermittent a transmission of driving force between the first shaft and the first pulley, a reduction gear disposed on one end of the third shaft through an one-way clutch and engaged with the second timing gear, a second pulley disposed on the other end of the third shaft and a driving force transmission means for transmitting driving force of engine to the first and second pulleies so that the first and second pulleies are simultaneously rotated in the same direction. Thereby, it is possible to reduce the number of the additional parts for changing the supercharging quantity in response to the condition of the engine and it is possible to prevent the unnecessary increasing of the rotating mass of the rotation groups which are rotated for supercharging.

4 Claims, 5 Drawing Sheets

TWO SPEED MECHANICAL SUPERCHARGER

BACKGROUND OF THE INVENTION

1. Field of the Invention

The present invention relates to a mechanical supercharger, and more particularly to a mechanical supercharger for supercharging an engine for automobiles and so on.

2. Description of the Prior Art

A conventional mechanical supercharger is disclosed, for example, in Japanese utility model application laid-open publication No. 2(1990)-34728. As shown in FIG. 8, this conventional mechanical supercharger 80 includes four shafts 82, 83, 89, 90 rotatably supported on a housing 81, rotors 84, 85 disposed on the about center portion of the shafts 82, 83, respectively and timing gears 86, 87 disposed on one end of the shafts 82, 83 respectively so that both shafts 82, 83 are synchronously rotated. In this mechanical supercharger 80, a variable speed mechanism 88 is disposed between the shafts 89, 83. Thereby, the rotation of the shaft 89 is increased and is transmitted to the shaft 83. Similarly, a variable speed mechanism 91 is disposed between the shafts 90, 83. Thereby, the rotation of the shaft 90 is increased and is transmitted to the shaft 83. Now, the variable ratio of the variable speed mechanism 88 differs from the variable speed ratio of the variable speed mechanism 91. Furthermore, in this mechanical supercharger 80, pulleys 94, 95 are installed on end portions of the shafts 89, 90 through electromagnetic clutches 92, 93, respectively. These pulleys 94, 95 are driven by a driving source such as an engine (not shown) and so on through a belt (not shown) and the operational condition of the electromagnetic clutches 92, 93 are controlled by a control device 96.

In this conventional mechanical supercharger 80, either of the electromagnetic clutches 92, 93 is selectively connected by the control device 96 and the rotors 84, 85 are driven in accordance with the variable speed ratio of either of the variable speed mechanisms 88, 91. Thereby, the supercharging pressure of the mechanical supercharger 80 is changed.

In the above conventional mechanical supercharger 80, however, since two expensive electromagnetic clutches are employed and furthermore two variable speed mechanisms are employed, the cost and the weight of the mechanical supercharger increase remarkably.

Furthermore, when either of the electromagnetic clutches 92, 93 is connected, the shafts 82, 83, 89, 90 and all of rotational members (each gear and so on) which are disposed on the shafts 82, 83, 89, 90 are driven. When the electromagnetic clutch 92 is connected, for example, it is not necessary to rotate a rotation group of the shaft 90. Nevertheless, the rotation group of the shaft 90 is rotated. Accordingly, the rotating mass of the rotation groups which are rotated for supercharging increases and therefore the response of the mechanical supercharger deteriorates.

SUMMARY OF THE INVENTION

It is, therefore, an object of the present invention to provide an improved mechanical supercharger which overcomes the above drawbacks.

It is another object of the present invention to provide an improved mechanical supercharger which includes a simple variable speed mechanism and which can decrease the rotating mass of the rotation groups which are rotated for supercharging.

In order to achieve these objects, there is provided a mechanical supercharger which includes a housing, first, second and third shafts rotatably supported on the housing, respectively, a first timing gear disposed on the first shaft, a second timing gear disposed on the second shaft and engaged with the first timing gear, a first rotor disposed on the first shaft, a second rotor disposed on the second shaft and engaged with the first rotor, a first pulley disposed on one end of the first shaft, an electromagnetic clutch interposed between the first shaft and the first pulley and selectively transmitting driving force between the first shaft and the first pulley, a reduction gear disposed on one end of the third shaft through an one-way clutch and engaged with the second timing gear, a second pulley disposed on the other end of the third shaft and a driving force transmission means for transmitting driving force of the engine to the first and second pulleys so that the first and second pulleys are simultaneously rotated in the same direction.

BRIEF DESCRIPTION OF THE DRAWINGS

Additional objects and advantages of the present invention will become more apparent from the following detailed description of preferred embodiments thereof when considered with reference to the attached drawings, in which.

DESCRIPTION OF THE PREFERRED EMBODIMENTS

A mechanical supercharger constituted in accordance with embodiments of the present invention will be described with reference to the attached drawings.

Figure 1:
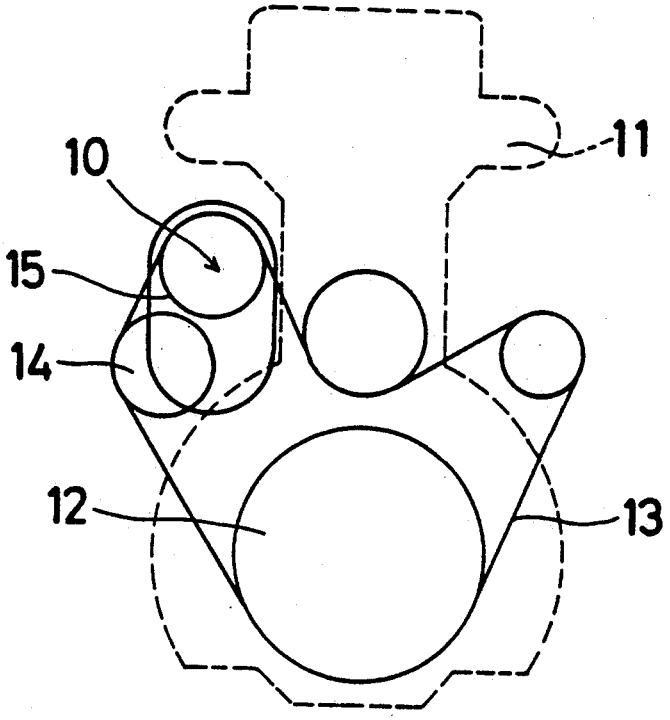
FIG. 1 is a schematic illustration of an engine which is equipped with a mechanical supercharger in accordance with a first embodiment of the present invention.
Figure 2:
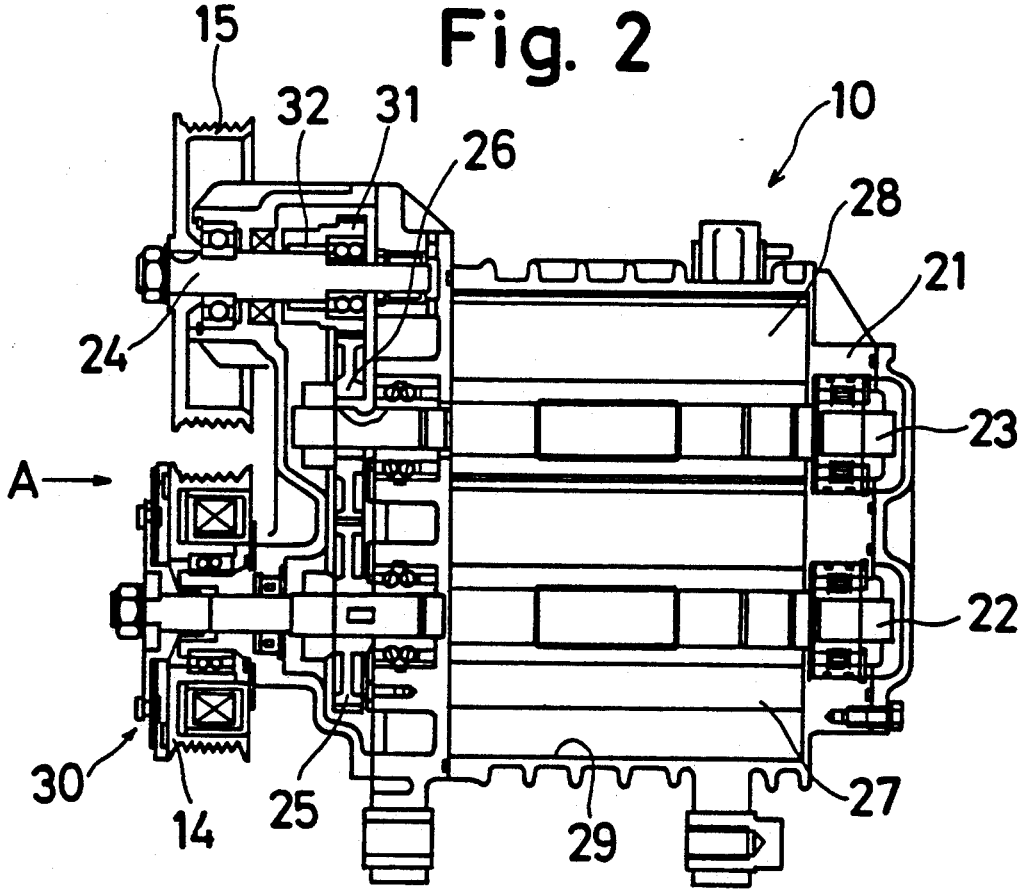
FIG. 2 is a sectional view of a first embodiment of a mechanical supercharger in accordance with the present invention.
Figure 3:
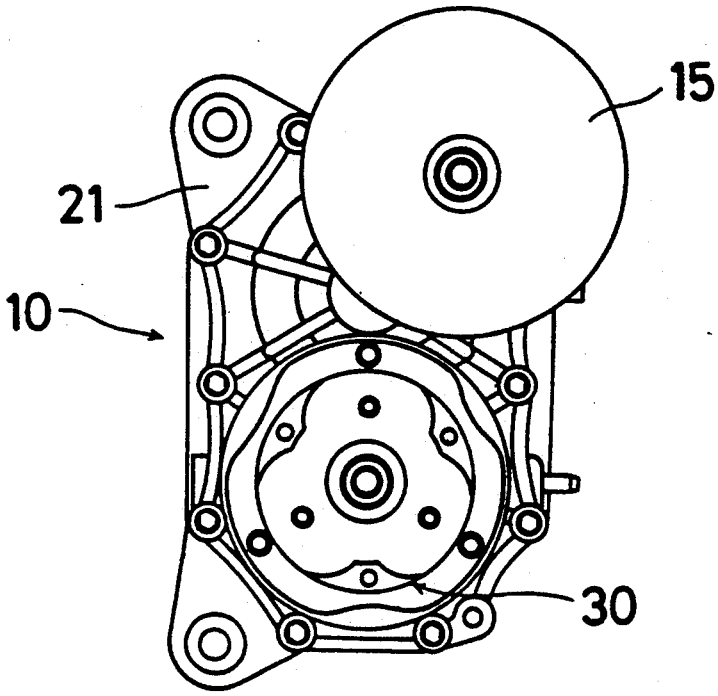
FIG. 3 is a A-arrow view of FIG. 2.

FIG. 1 to FIG. 3 show a first embodiment of the present invention. Referring to FIG. 1, a crankpulley 12 of engine 11 is connected with a first pulley 14 and a second pulley 15 of a mechanical supercharger 10 through a belt 13 so that the mechanical supercharger 10 is driven by the crankpulley 12 of the engine 11 through the belt 13. Thereby, the first and second pulleies 14, 15 are simultaneously rotated by the engine 11 through the belt 13 in the same direction and therefore the belt 13 corresponds to a driving force transmission means of the present invention.

Referring to FIG. 2 and FIG. 3, first, second and third shafts 22, 23, 24 are rotatably supported on a housing 21 of the mechanical supercharger 10 though bearings. A first timing gear 25 and a first rotor 27 are fixed on the first shaft 22. On the other hand, a second timing gear 26 and a second rotor 28 which are engaged with the first timing gear 25 and the first rotor 27 respectively are fixed on the second shaft 23. In the housing 21, a volume chamber 29 which is communicated with an inlet port and an outlet port (not shown) is formed therein and the first rotor 27 and the second rotor 28 are rotated in the volume chamber 29.

The first pulley 14 is diposed on one end of the first shaft 22 through a electromagnetic clutch 30. The electromagnetic clutch 30 is interposed between the first shaft 22 and the first pulley 14 and is controlled by a control device (not shown) so as to intermittently transmit driving force between the first shaft 22 and the first pulley 14 selectively. A reduction gear 31 which is engaged with the second timing gear 26 is disposed on one end of the third shaft 24 through an one-way clutch 32. The second pulley 15 is fixed on the other end of the third shaft 24. The one-way clutch 32 is interposed between the third shaft 24 and the second pulley 15 and functions so as not to transmit the rotation of the reduction gear 31 to the third shaft 24 when the reduction gear 31 is driven by the second timing gear 26. Now, the rotation of the third shaft 24 is transmitted to the reduction gear 31 when the reduction gear 31 is not driven by the second timing gear 26.

The above-described first embodiment of the mechanical supercharger operates as follows. When the engine 11 is started, the first pulley 14 and the second pulley 15 are simultaneously driven by the crankpulley 12 through the belt 13 in the same direction. In case of large required supercharging quantity of the engine 11, the electromagnetic clutch 30 is connected (ON-condition) by the control device (not shown). In this case, the driving force of the belt 13 which is connected with the first pulley 14 is transmitted to the first shaft 22 through the electromagnetic clutch 30 and then is transmitted to the second shaft 23 through the first timing gear 25 and the second timing gear 26. Accordingly, the first rotor 27 and the second rotor 28 are synchronously rotated in the volume chamber 29. Thereby, air is discharged from the inlet port (not shown) to the outlet port through the volume chamber 29 and the engine 11 is supercharged. In this situation, the rotation of the first pulley 14 is transmitted to the first rotor 27 and the second rotor 28 without increasing or decreasing the rotational speed of the first pulley 14 and the ratio between the rotational speeds of the first pulley 14 and the rotors 27, 28 is 1:1.

Similarly, the reduction gear 31 is rotated by the second timing gear 26 and the rotational speed of the reduction gear 31 is increased in accordance with the reduction ratio between the reduction gear 31 and the second timing gear 26. On the other hand, the second pulley 15 and the third shaft 24 are driven by the belt 13. The rotational speed of the third shaft 24 is as same as the first pulley 14 and is lower than that of the reduction gear 31. In this situation, since the rotation of the reduction gear 31 is not transmitted to the third shaft 24 by the function of the one-way clutch 32 and therefore the third shaft 24 synchronized with regard to the reduction gear 31, however, there is no problem in the operation of the mechanical supercharger 10.

Figure 7:
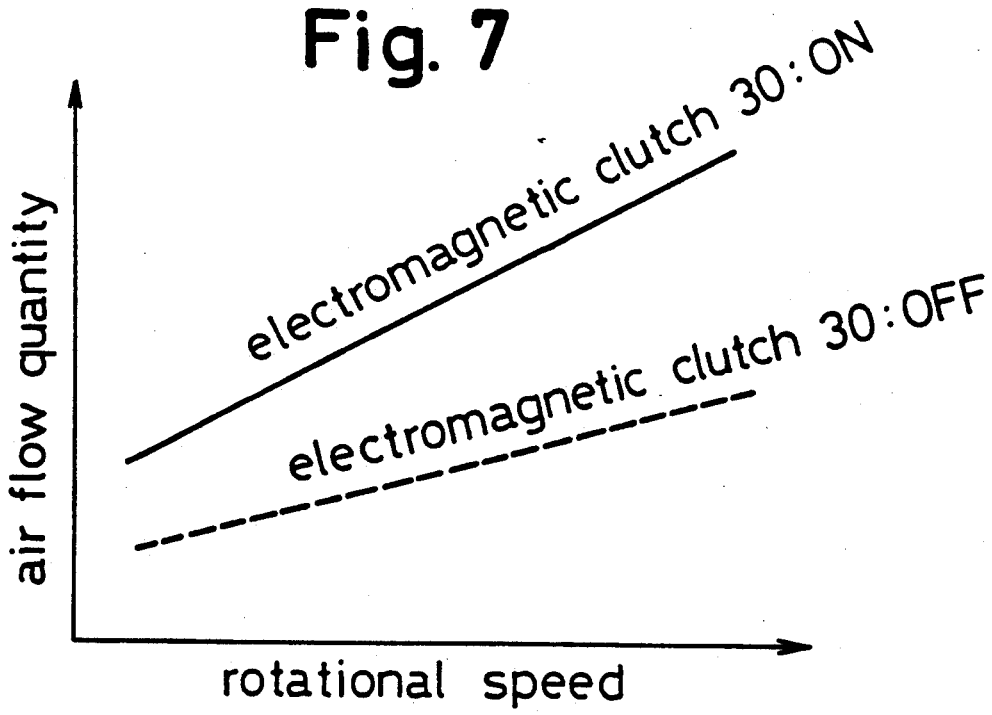
FIG. 7 is a supercharging characteristic view of first and second embodiments of a mechanical supercharger in accordance with the present invention; and, FIG. 8 is a sectional view of a prior mechanical supercharger.
Figure 8:
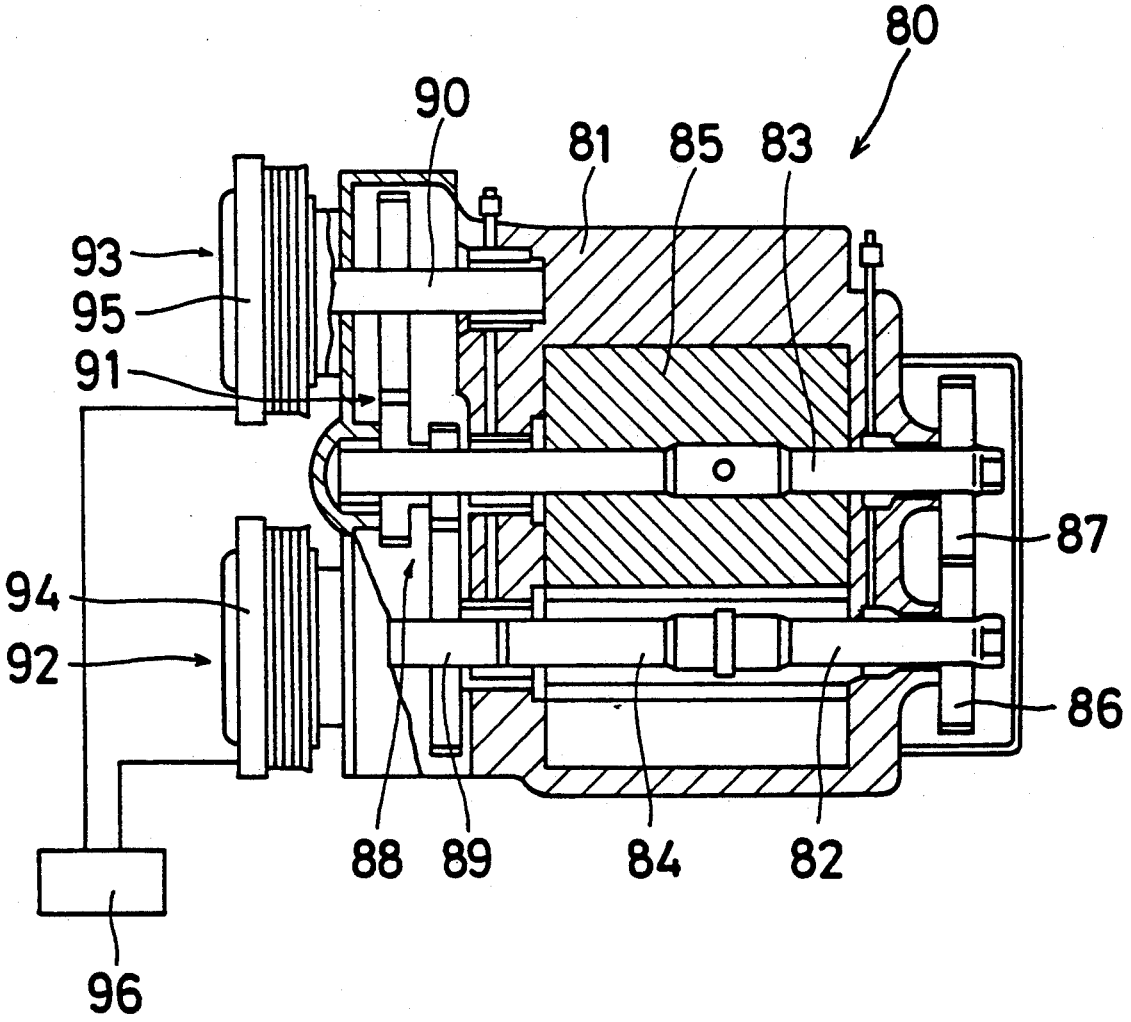
Fig. 8 PRIOR ART

On the other hand, in case of small required supercharging quantity of the engine 11, the electromagnetic clutch 30 is disconnected (OFF-condition) by the control device (not shown). Therefore, the driving force of the belt 13 which is connected with the first pulley 14 is not transmitted to the first shaft 22. In this case, the driving force of the belt 13 which is connected with the second pulley 15 is transmitted to the second timing gear 26 through the third shaft 24, one-way clutch 32 and the reduction gear 31. In this situation, the rotational speed of the second timing gear 26 is reduced in accordance with the reduction ratio between the reduction gear 31 and the second timing gear 26 and the reduced rotation of the second timing gear 26 is transmitted to the second shaft 23. Then, the driving force of the belt 13 is transmitted to the first shaft 22 through the first timing gear 25 and the second timing gear 26. Accordingly, the first rotor 27 and the second rotor 28 are synchronously rotated in the volume chamber 29. Thereby, air is discharged from the inlet port (not shown) to the outlet port through the volume chamber 29 and the engine 11 is supercharged. In this situation, the supercharging quantity is smaller than that in the situation which the electromagnetic clutch 30 is connected (ON-condition) and each of the supercharging characteristics in the situations which the electromagnetic clutch 30 is connected (ON-condition) and is disconnected (OFF-condition) is shown in FIG. 7. Now, the condition of the electromagnetic clutch 30 is controlled by the control device (not shown) in response to the condition of the engine 11 such as the load of the engine 11 and so on.

Figure 4:
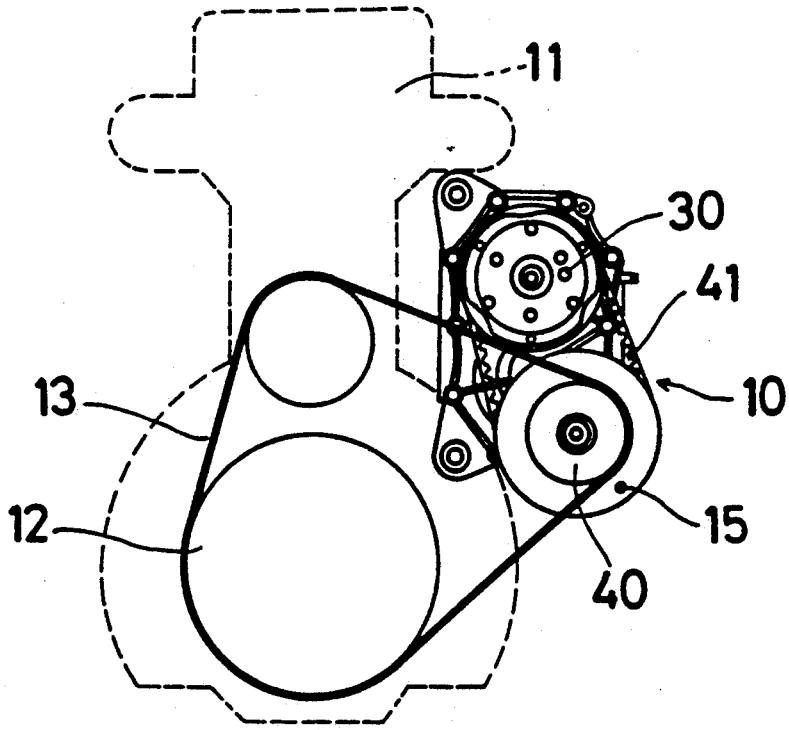
FIG. 4 is a schematic illustration of an engine which is equipped with a mechanical supercharger in accordance with a second embodiment of the present invention.
Figure 5:
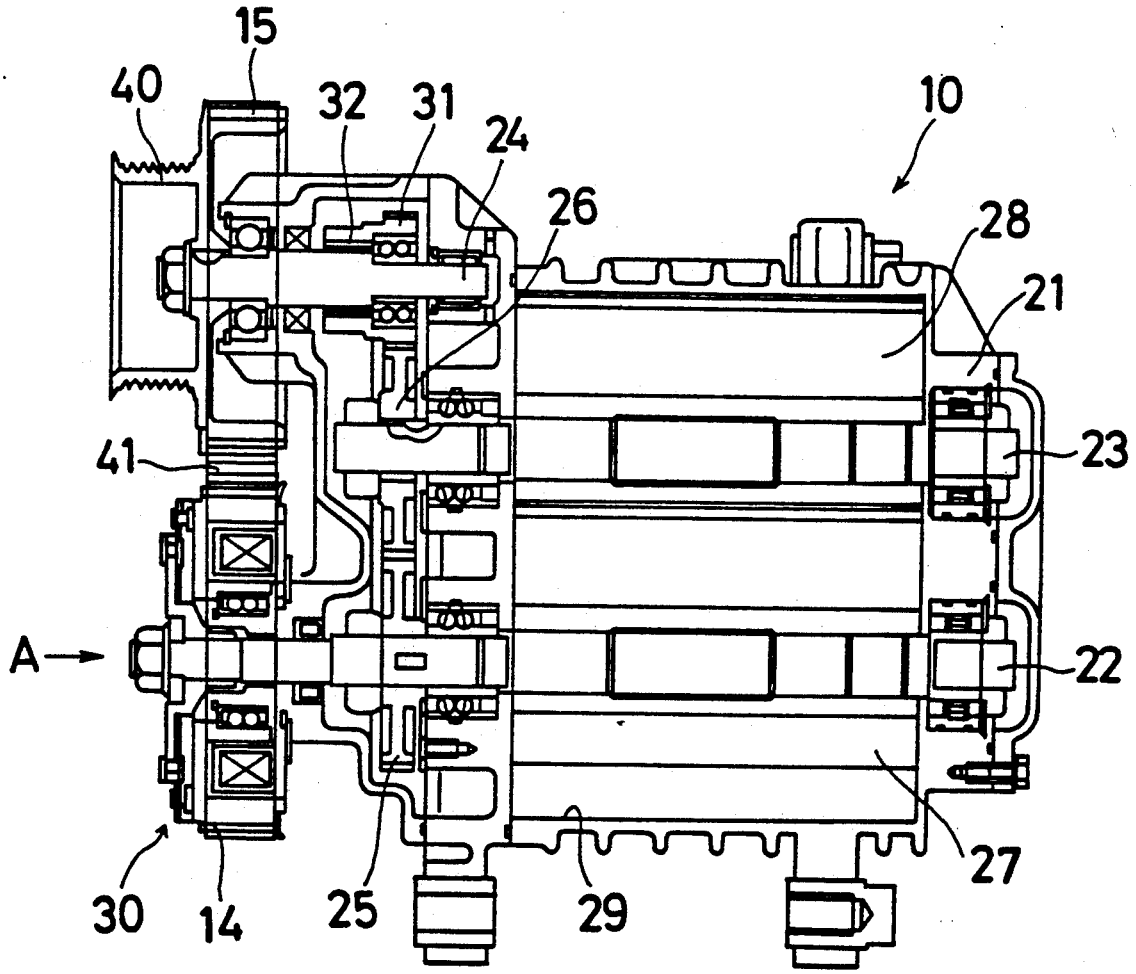
FIG. 5 is a sectional view of a second embodiment of a mechanical supercharger in accordance with the present invention.
Figure 6:
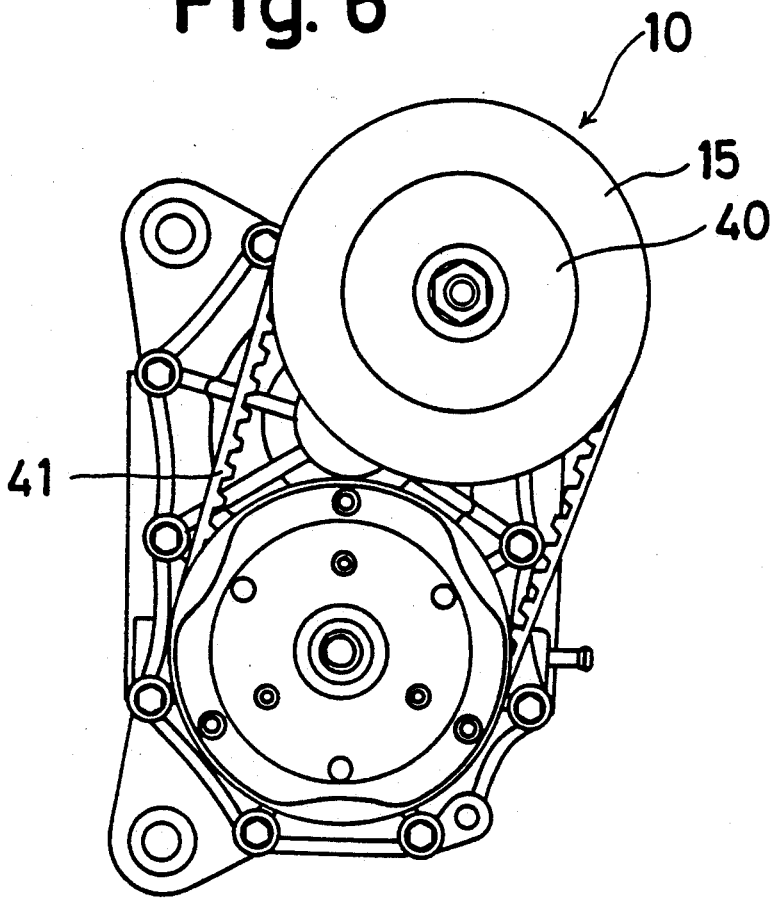
FIG. 6 is a A-arrow view of FIG. 5.

FIG. 4 to FIG. 6 show a second embodiment of the present invention. In the FIG. 4 to FIG. 6, the same parts as compared with FIG. 1 to FIG. 3 use the same numeral utilized the FIG. 1 to FIG. 3. Referring to FIG. 4 and FIG. 5, the first pulley 14 is connected with the second pulley 15 though a connecting member 41 such as a belt, a chain and so on so that the first and second pulleies 14, 15 are simultaneously rotated in the same direction. At the second pulley 15, a third pulley 40 is fixed thereto so as to be rotated with the second pulley 15 in one body. The third pulley 40 is connected with the crankpulley 12 of the engine 11 through the belt 13 so that the mechanical supercharger 50 is driven by the crankpulley 12 of the engine 11 through the belt 13. Thereby, the first and second pulleies 14, 15 are simultaneously rotated by the engine 11 through belt 13, the third pulley 40 and the connecting member 41 in the same direction and therefore the belt 13, the third pulley 40 and the connecting member 41 correspond to a driving force transmission means of the present invention. Now, since the other structures are as same as the first embodiment shown by FIG. 1 to FIG. 3, further description is omitted.

According to this embodiment, when the engine 11 is started, the third pulley 40 is driven by the crankpulley 12 through the belt 13. Then, the driving force of the belt 13 which is transmitted to the third pulley 40 is transmitted to the first pulley 14 through the second pulley 15 and the connecting member 41. In case of large required supercharging quantity of the engine 11, the electromagnetic clutch 30 is connected (ON-condition) by the control device (not shown). In this case, the above described driving force of the belt 13 which is connected with the first pulley 14 is transmitted to the first shaft 22 through the electromagnetic clutch 30 and then is transmitted to the second shaft 23 through the first timing gear 25 and the second timing gear 26. Accordingly, the first rotor 27 and the second rotor 28 are synchronously rotated in the volume chamber 29. Thereby, air is discharged from the inlet port (not shown) to the outlet port through the volume chamber 29 and the engine 11 is supercharged. In this situation, the rotation of the third pulley 40 as an inlet pulley is transmitted to the first rotor 27 and the second rotor 28 without increasing or decreasing the rotational speed of the third pulley 40 and the ratio between the rotational speeds of the third pulley 40 and the rotors 27, 28 is 1:1.

Similarly, the reduction gear 31 is rotated by the second timing gear 26 and the rotational speed of the reduction gear 31 is increased in accordance with the reduction ratio between the reduction gear 31 and the second timing gear 26. On the other hand, the third pulley 40, the second pulley 15 and the third shaft 24 are driven by the belt 13. The rotational speed of the third shaft 24 is as same as the first pulley 14 and is lower than that of the reduction gear 31. In this situation, since the rotation of the reduction gear 31 is not transmitted to the third shaft 24 by the function of the one-way clutch 32 and therefore the third shaft 24 is not synchronized with regard to the reduction gear 31, however, there is no problem in the operation of the mechanical supercharger 50.

On the other hand, in case of small required supercharging quantity of the engine 11, the electromagnetic clutch 30 is disconnected (OFF-condition) by the control device (not shown). Therefore, the driving force of the belt 13 which is connected with the first pulley 14 is not transmitted to the first shaft 22. In this case, the driving force of the belt 13 which is connected with the third pulley 40 and the second pulley 15 is transmitted to the second timing gear 26 through the third shaft 24, one-way clutch 32 and the reduction gear 31. In this situation, the rotational speed of the second timing gear 26 is reduced in accordance with the reduction ratio between the reduction gear 31 and the second timing gear 26 and the reduced rotation of the second timing gear 26 is transmitted to the second shaft 23. Then, the driving force of the belt 13 is transmitted to the first shaft 22 through the first timing gear 25 and the second timing gear 26. Accordingly, the first rotor 27 and the second rotor 28 are synchronously rotated in the volume chamber 29. Thereby, air is discharged from the inlet port (not shown) to the outlet port through the volume chamber 29 and the engine 11 is supercharged. Accordingly, the supercharging quantity is changed in response to the condition of the electromagnetic clutch 30 and each of the supercharging characteristics in the situations in which the electromagnetic clutch 30 is connected (ON-condition) and is disconnected (OFF-condition) is shown in FIG. 7. Now, the condition of the electromagnetic clutch 30 is controlled by the control device (not shown) in response to the condition of the engine 11 such as the load of the engine 11 and so on.

According to the present invention, as mentioned above, it is possible to reduce the number of the additional parts (the elctromagnetic clutch, the reduction gear and so on) for changing the supercharging quantity in response to the condition of the engine such as the load of the engine and so on and therefore the structure of the mechanical supercharger is simplified. Thereby, it is possible to reduce the cost of the mechanical supercharger. Furthermore, it is possible to improve the reliability of the mechanical supercharger.

Furthermore, since it is possible to separate the third shaft from the first and second shafts by the function of the one-way clutch selectively, it is possible to prevent the unnecessary increasing of the rotating mass of the rotation groups which are rotated for supercharging and therefore it is possible to improve the response of the mechanical supercharger.

The principles, preferred embodiments, and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A mechanical supercharger comprising:

a housing;

a pair of rotors rotatably arranged in the housing and engaged with each other;

a first shaft supporting one of the rotors and rotatably supported by the housing;

a second shaft supporting the other of rotors and rotatably supported by the housing, the second shaft being in parallel with the first shaft at one side thereof;

a first timing gear secured to the first shaft;

a second timing gear secured to the second shaft and meshed with the first timing gear;

a third shaft rotatably supported by the housing and located at one side of the second shaft so as to be in parallel therewith;

transmission means for transmitting an engine rotation to the first shaft and the third shaft, the transmission means having two separate pulleys, both of which rotate in a same direction;

clutch means disposed on the first shaft for establishing an optional connection between one of the pulleys and the first shaft;

a reduction gear secured on the third shaft and meshed with the second timing gear; and a one-way clutch disposed on the third shaft and disconnecting the other of the pulleys from the third shaft when the clutch means is in engagement.

2. A mechanical supercharger according to claim 1, wherein the transmission means includes a first pulley connected to the first shaft, a second pulley connected to the third shaft, and a common belt for transmitting the engine rotation to the first pulley and the second pulley.

3. A mechanical supercharger according to claim 1, wherein the transmission means includes a first driven gear connected to the first shaft, a second driven gear connected to the second shaft and meshed with the first driven gear, a pulley secured to the first driven gear, and a belt for transmitting the engine rotation to the pulley.

4. A mechanical supercharger according to claim 1, wherein the clutch means is an electromagnetic clutch.

* * * * *